US007529660B2

(12) United States Patent
Bessette et al.

(10) Patent No.: US 7,529,660 B2
(45) Date of Patent: May 5, 2009

(54) METHOD AND DEVICE FOR FREQUENCY-SELECTIVE PITCH ENHANCEMENT OF SYNTHESIZED SPEECH

(75) Inventors: Bruno Bessette, Rock Forest (CA); Claude Laflamme, Bonsecours (CA); Milan Jelinek, Sherbrooke (CA); Roch Lefebvre, Canton de Magog (CA)

(73) Assignee: VoiceAge Corporation, Quebec (CA)

( * ) Notice: Subject to any disclaimer, the term of this patent is extended or adjusted under 35 U.S.C. 154(b) by 873 days.

(21) Appl. No.: 10/515,553

(22) PCT Filed: May 30, 2003

(86) PCT No.: PCT/CA03/00828

§ 371 (c)(1),
(2), (4) Date: Nov. 23, 2004

(87) PCT Pub. No.: WO03/102923

PCT Pub. Date: Dec. 11, 2003

(65) Prior Publication Data

US 2005/0165603 A1 Jul. 28, 2005

(30) Foreign Application Priority Data

May 31, 2002 (CA) ..... 2388352

(51) Int. Cl.
*G10L 19/02* (2006.01)
*G10L 21/02* (2006.01)

(52) U.S. Cl. ..... 704/205; 704/207; 704/502

(58) Field of Classification Search ..... 704/205, 704/206, 207, 226, 227, 228, 500, 501, 502
See application file for complete search history.

(56) References Cited

U.S. PATENT DOCUMENTS 5,651,092 A * 7/1997 Ishii et al. ..... 704/226
5,701,390 A * 12/1997 Griffin et al. ..... 704/206
5,806,025 A 9/1998 Vis et al.
5,864,798 A 1/1999 Oshikiri et al.

(Continued)

FOREIGN PATENT DOCUMENTS

RU 2181481 4/2008

(Continued)

OTHER PUBLICATIONS

R. Salami, et al., "Design and Description of CS-ACELP: A Toll Quality 8 kb/s Speech Coder," IEEE Transactions On Speech and Audio Proc., vol. 6, No. 2, Mar. 1998, pp. 116-130.

(Continued)

*Primary Examiner*—Martin Lerner
(74) *Attorney, Agent, or Firm*—K&L Gates LLP

(57) ABSTRACT

In a method and device for post-processing a decoded sound signal in view of enhancing a perceived quality of this decoded sound signal, the decoded sound signal is divided into a plurality of frequency sub-band signals, and post-processing is applied to at least one of the frequency sub-band signal. After post-processing of this at least one frequency sub-band signal, the frequency sub-band signals may be added to produce an output post-processed decoded sound signal. In this manner, the post-processing can be localized to a desired sub-band or sub-bands with leaving other sub-bands virtually unaltered.

58 Claims, 11 Drawing Sheets

U.S. PATENT DOCUMENTS

| | | | | |
|---|---|---|---|---|
| 6,029,128 | A | 2/2000 | Jarvinen | |
| 6,138,093 | A * | 10/2000 | Ekudden et al. | 704/228 |
| 6,385,576 | B2 * | 5/2002 | Amada et al. | 704/223 |
| 6,795,805 | B1 * | 9/2004 | Bessette et al. | 704/223 |
| 6,889,182 | B2 * | 5/2005 | Gustafsson | 704/205 |
| 6,937,978 | B2 * | 8/2005 | Liu | 704/228 |
| 7,167,828 | B2 * | 1/2007 | Ehara | 704/223 |
| 7,260,521 | B1 * | 8/2007 | Bessette et al. | 704/219 |
| 7,280,959 | B2 * | 10/2007 | Bessette | 704/219 |
| 7,286,980 | B2 * | 10/2007 | Wang et al. | 704/205 |
| 2005/0065785 | A1 * | 3/2005 | Bessette | 704/211 |

FOREIGN PATENT DOCUMENTS

| | | |
|---|---|---|
| SU | 447853 | 10/1974 |
| SU | 447857 | 10/1974 |
| WO | WO97/00516 | 1/1997 |

OTHER PUBLICATIONS

3GPP TS 26.190, "AMR Wideband Speech Codec: Transcoding Functions," 3GGP Technical Specification, vol. 7.0.0 (Jun. 2007), pp. 1-53.

P. Kroon and W. B. Kleijn, Speech Coding and Synthesis Edited by W.B. Keijn and K.K. Paliwal, "Chapter 3: Linear-Prediction based Analysis-by-Synthesis Coding," Elsevier Science B.V., 1995, pp. 79-119.

International Search Report; International Application No. PCT/CA03/00828; mailed on May 30, 2003; 4 pgs.

Chan, C. F. et al., "Frequency Domain Postfiltering for Multiband Excited Linear Predictive Coding of Speech," Electronics Letters, vol. 32, No. 12, Jun. 6, 1996, pp. 1061-1063.

Chen, Juin-Hwey, "Adaptive Postfiltering for Quality Enhancement of Coded Speech," IEEE Transactions on Speech and Audio Processing, vol. 3, No. 1, Jan. 1995, pp. 59-71.

"Wideband Copies of Speech at Around 16 kbit/s Using Adaptive Multi-Rate Wideband (AMR-WB)," International Telecommunication Union, ITU-T Recommendation G.722.2, Jan. 2002 (71 pgs.).

* cited by examiner $\alpha = 1$ $\alpha = 0.8$

METHOD AND DEVICE FOR FREQUENCY-SELECTIVE PITCH ENHANCEMENT OF SYNTHESIZED SPEECH

CROSS-REFERENCE TO RELATED APPLICATIONS

This application is the national phase of International (PCT) Patent Application Serial No. PCT/CA03/00828, filed May 30, 2003, published under PCT Article 21(2) in English, which claims priority to and the benefit of Canadian Patent Application No. 2,388,352, filed May 31, 2002, the disclosures of which are incorporated herein by reference.

BACKGROUND OF THE INVENTION

1. Field of the Invention

The present invention relates to a method and device for post-processing a decoded sound signal in view of enhancing a perceived quality of this decoded sound signal.

This post-processing method and device can be applied, in particular but not exclusively, to digital encoding of sound (including speech) signals. For example, this post-processing method and device can also be applied to the more general case of signal enhancement where the noise source can be from any medium or system, not necessarily related to encoding or quantization noise.

2. Brief Description of the Current Technology 2.1 Speech Encoders

Speech encoders are widely used in digital communication systems to efficiently transmit and/or store speech signals. In digital systems, the analog input speech signal is first sampled at an appropriate sampling rate, and the successive speech samples are further processed in the digital domain. In particular, a speech encoder receives the speech samples as an input, and generates a compressed output bit stream to be transmitted through a channel or stored on an appropriate storage medium. At the receiver, a speech decoder receives the bit stream as an input, and produces an output reconstructed speech signal.

To be useful, a speech encoder must produce a compressed bit stream with a bit rate lower than the bit rate of the digital, sampled input speech signal. State-of-the-art speech encoders typically achieve a compression ratio of at least 16 to 1 and still enable the decoding of high quality speech. Many of these state-of-the-art speech encoders are based on the CELP (Code-Excited Linear Predictive) model, with different variants depending on the algorithm.

In CELP encoding, the digital speech signal is processed in successive blocks of speech samples called frames. For each frame, the encoder extracts from the digital speech samples a number of parameters that are digitally encoded, and then transmitted and/or stored. The decoder is designed to process the received parameters to reconstruct, or synthesize the given frame of speech signal. Typically, the following parameters are extracted from the digital speech samples by a CELP encoder:

- Linear Prediction Coefficients (LP coefficients), transmitted in a transformed domain such as the Line Spectral Frequencies (LSF) or Immitance Spectral Frequencies (ISF);
- Pitch parameters, including a pitch delay (or lag) and a pitch gain; and
- Innovative excitation parameters (fixed codebook index and gain).

The pitch parameters and the innovative excitation parameters together describe what is called the excitation signal. This excitation signal is supplied as an input to a Linear Prediction (LP) filter described by the LP coefficients. The LP filter can be viewed as a model of the vocal tract, whereas the excitation signal can be viewed as the output of the glottis. The LP or LSF coefficients are typically calculated and transmitted every frame, whereas the pitch and innovative excitation parameters are calculated and transmitted several times per frame. More specifically, each frame is divided into several signal blocks called subframes, and the pitch parameters and the innovative excitation parameters are calculated and transmitted every subframe. A frame typically has a duration of 10 to 30 milliseconds, whereas a subframe typically has a duration of 5 milliseconds.

Several speech encoding standards are based on the Algebraic CELP (ACELP) model, and more precisely on the ACELP algorithm. One of the main features of ACELP is the use of algebraic codebooks to encode the innovative excitation at each subframe. An algebraic codebook divides a subframe in a set of tracks of interleaved pulse positions. Only a few non-zero-amplitude pulses per track are allowed, and each non-zero-amplitude pulse is restricted to the positions of the corresponding track. The encoder uses fast search algorithms to find the optimal pulse positions and amplitudes for the pulses of each subframe. A description of the ACELP algorithm can be found in the article of *R. SALAMI* et al., *"Design and description of CS-ACELP: a toll quality* 8 *kb/s speech coder" IEEE Trans. on Speech and Audio Proc.,* Vol. 6, No. 2, pp. 116-130, March 1998, herein incorporated be reference, and which describes the ITU-T G.729 CS-ACELP narrowband speech encoding algorithm at 8 kbits/second. It should be noted that there are several variations of the ACELP innovation codebook search, depending on the standard of concern. The present invention is not dependent on these variations, since it only applies to post-processing of the decoded (synthesized) speech signal.

A recent standard based on the ACELP algorithm is the ETSI/3GPP AMR-WB speech encoding algorithm, which was also adopted by the ITU-T (Telecommunication Standardization Sector of ITU (International Telecommunication Union)) as recommendation G.722.2 . [*ITU-T Recommendation G.*722.2 "*Wideband coding of speech at around* 16 *kbit/s using Adaptive Multi-Rate Wideband* (*AMR-WB*)" Geneva, 2002], [3GPP TS 26.190, "*AMR Wideband Speech Codec: Transcoding Functions,"* 3*GPP Technical Specification*]. The AMR-WB is a multi-rate algorithm designed to operate at nine different bit rates between 6.6 and 23.85 kbits/second. Those of ordinary skill in the art know that the quality of the decoded speech generally increases with the bit rate. The AMR-WB has been designed to allow cellular communication systems to reduce the bit rate of the speech encoder in the case of bad channel conditions; the bits are converted to channel encoding bits to increase the protection of the transmitted bits. In this manner, the overall quality of the transmitted bits can be kept higher than in the case where the speech encoder operates at a single fixed bit rate.

FIG. 7 is a schematic block diagram showing the principle of the AMR-WB decoder. More specifically, FIG. 7 is a high-level representation of the decoder, emphasizing the fact that the received bitstream encodes the speech signal only up to 6.4 kHz (12.8 kHz sampling frequency), and the frequencies higher than 6.4 kHz are synthesized at the decoder from the lower-band parameters. This implies that, in the encoder, the original wideband, 16 kHz-sampled speech signal was first down-sampled to the 12.8 kHz sampling frequency, using multi-rate conversion techniques well known to those of ordinary skill in the art. The parameter decoder 701 and the speech decoder 702 of FIG. 7 are analogous to the parameter decoder 106 and the source decoder 107 of FIG. 1. The received bitstream 709 is first decoded by the parameter decoder 701 to recover parameters 710 supplied to the speech decoder 702 to resynthesize the speech signal. In the specific case of the AMR-WB decoder, these parameters are:

ISF coefficients for every frame of 20 milliseconds;

An integer pitch delay T0, a fractional pitch value T0_frac around T0, and a pitch gain for every 5 millisecond subframe; and An algebraic codebook shape (pulse positions and signs) and gain for every 5 millisecond subframe.

From the parameters 710, the speech decoder 702 is designed to synthesize a given frame of speech signal for the frequencies equal to and lower than 6.4 kHz, and thereby produce a low-band synthesized speech signal 712 at the 12.8 kHz sampling frequency. To recover the full-band signal corresponding to the 16 kHz sampling frequency, the AMR-WB decoder comprises a high-band resynthesis processor 707 responsive to the decoded parameters 710 from the parameter decoder 701 to resynthesize a high-band signal 711 at the sampling frequency of 16 kHz. The details of the high-band signal resynthesis processor 707 can be found in the following publications which are herein incorporated by reference:

*ITU-T Recommendation G.* 722.2 *"Wideband coding of speech at around* 16 *kbit/s using Adaptive Multi-Rate Wideband* (*AMR-WB*)", Geneva, 2002; and 3*GPP TS* 26.190, *"AMR Wideband Speech Codec: Transcoding Functions,"* 3*GPP Technical Specification.*

The output of the high-band resynthesis processor 707, referred to as the high-band signal 711 of FIG. 7, is a signal at the 16 kHz sampling frequency, having an energy concentrated above 6.4 kHz. The processor 708 sums the high-band signal 711 to a 16-kHz up-sampled low-band speech signal 713 to form the complete decoded speech signal 714 of the AMR-WB decoder at the 16 kHz sampling frequency.

2.2 Need for Post-Processing

Whenever a speech encoder is used in a communication system, the synthesized or decoded speech signal is never identical to the original speech signal even in the absence of transmission errors. The higher the compression ratio, the higher the distortion introduced by the encoder. This distortion can be made subjectively small using different approaches. A first approach is to condition the signal at the encoder to better describe, or encode, subjectively relevant information in the speech signal. The use of a formant weighting filter, often represented as W(z), is a widely used example of this first approach [B. Kleijn and K. Paliwal editors, <<Speech Coding and Synthesis, >> Elsevier, 1995]. This filter W(z) is typically made adaptive, and is computed in such a way that it reduces the signal energy near the spectral formants, thereby increasing the relative energy of lower energy bands. The encoder can then better quantize lower energy bands, which would otherwise be masked by encoding noise, increasing the perceived distortion. Another example of signal conditioning at the encoder is the so-called pitch sharpening filter which enhances the harmonic structure of the excitation signal at the encoder. Pitch sharpening aims at ensuring that the inter-harmonic noise level is kept low enough in the perceptual sense.

A second approach to minimize the perceived distortion introduced by a speech encoder is to apply a so-called post-processing algorithm. Post-processing is applied at the decoder, as shown in FIG. 1. In FIG. 1, the speech encoder 101 and the speech decoder 105 are broken down in two modules. In the case of the speech encoder 101, a source encoder 102 produces a series of speech encoding parameters 109 to be transmitted or stored. These parameters 109 are then binary encoded by the parameter encoder 103 using a specific encoding method, depending on the speech encoding algorithm and on the parameters to encode. The encoded speech signal (binary encoded parameters) 110 is then transmitted to the decoder through a communication channel 104. At the decoder, the received bit stream 111 is first analysed by a parameter decoder 106 to decode the received, encoded sound signal encoding parameters, which are then used by the source decoder 107 to generate the synthesized speech signal 112. The aim of post-processing (see post-processor 108 of FIG. 1) is to enhance the perceptually relevant information in the synthesized speech signal, or equivalently to reduce or remove the perceptually annoying information. Two commonly used forms of post-processing are formant post-processing and pitch post-processing. In the first case, the formant structure of the synthesized speech signal is amplified by the use of an adaptive filter with a frequency response correlated to the speech formants. The spectral peaks of the synthesized speech signal are then accentuated at the expense of spectral valleys whose relative energy becomes smaller. In the case of pitch post-processing, an adaptive filter is also applied to the synthesized speech signal. However in this case, the filter's frequency response is correlated to the fine spectral structure, namely the harmonics. A pitch post-filter then accentuates the harmonics at the expense of inter-harmonic energy which becomes relatively smaller. Note that the frequency response of a pitch post-filter typically covers the whole frequency range. The impact is that a harmonic structure is imposed on the post-processed speech even in frequency bands that did not exhibit a harmonic structure in the decoded speech. This is not a perceptually optimal approach for wideband speech (speech sampled at 16 kHz), which rarely exhibits a periodic structure on the whole frequency range.

SUMMARY OF THE INVENTION

The present invention relates to a method for post-processing a decoded sound signal in view of enhancing a perceived quality of this decoded sound signal, comprising dividing the decoded sound signal into a plurality of frequency sub-band signals, and applying post-processing to at least one of the frequency sub-band signals, but not all the frequency sub-band signals.

The present invention is also concerned with a device for post-processing a decoded sound signal in view of enhancing a perceived quality of this decoded sound signal, comprising means for dividing the decoded sound signal into a plurality of frequency sub-band signals, and means for post-processing at least one of the frequency sub-band signals, but not all the frequency sub-band signals.

According to an illustrative embodiment, after post-processing of the above mentioned at least one frequency sub-band signal, the frequency sub-band signals are summed to produce an output post-processed decoded sound signal.

Accordingly, the post-processing method and device make it possible to localize the post-processing in the desired sub-band(s) and to leave other sub-bands virtually unaltered.

The present invention further relates to a sound signal decoder comprising an input for receiving an encoded sound signal, a parameter decoder supplied with the encoded sound signal for decoding sound signal encoding parameters, a sound signal decoder supplied with the decoded sound signal encoding parameters for producing a decoded sound signal, and a post processing device as described above for post-processing the decoded sound signal in view of enhancing a perceived quality of this decoded sound signal.

The foregoing and other objects, advantages and features of the present invention will become more apparent upon reading of the following, non restrictive description of illustrative embodiments thereof, given by way of example only with reference to the accompanying drawings.

DETAILED DESCRIPTION OF THE ILLUSTRATIVE EMBODIMENTS

Figure 2:
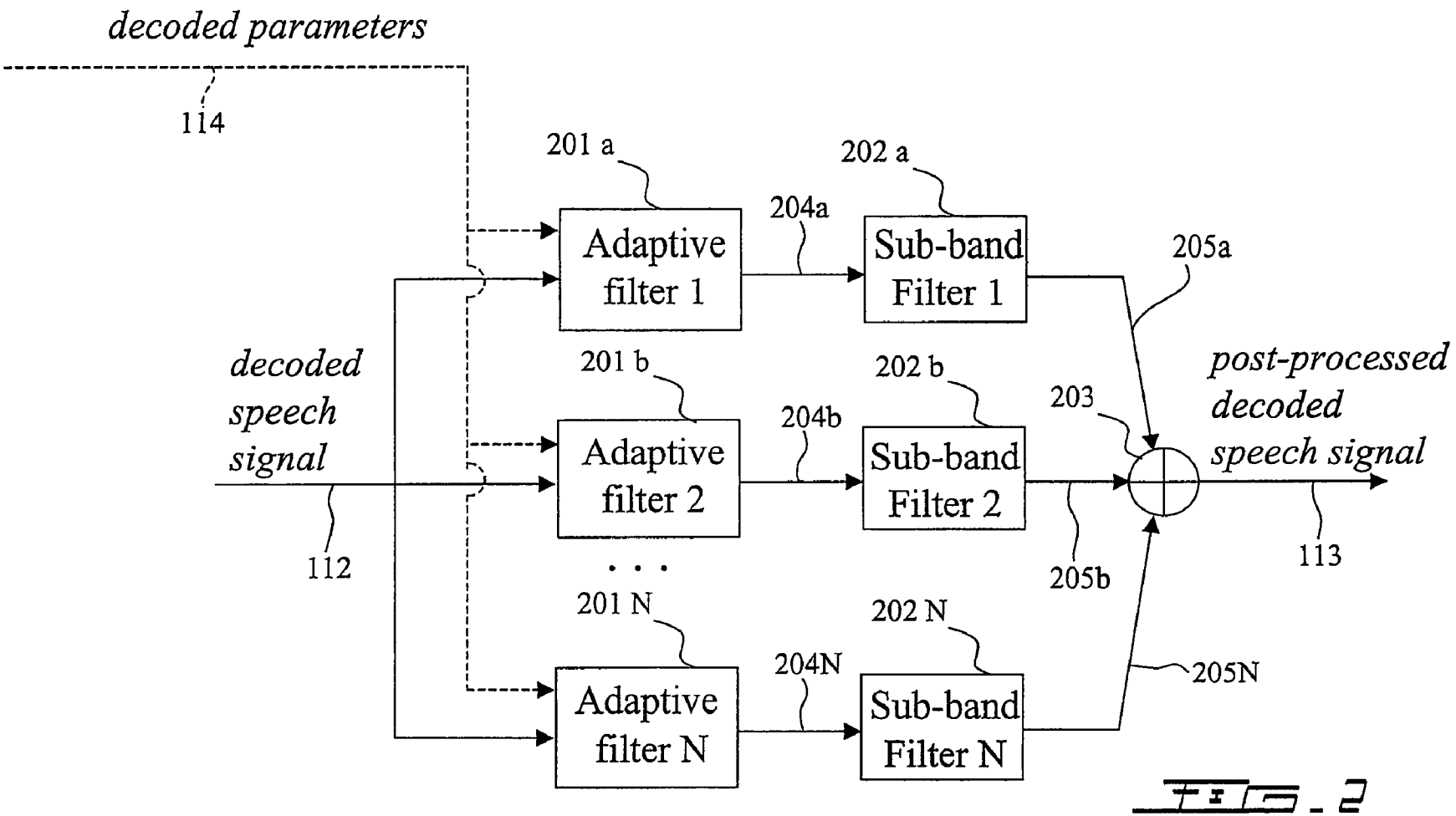
FIG. 2 is a schematic block diagram showing the general principle of an illustrative embodiment of the present invention using a bank of adaptive filters and sub-band filters, in which the input of the adaptive filters is the decoded (synthesized) speech signal (solid line) and the decoded parameters (dotted line)

FIG. 2 is a schematic block diagram illustrating the general principle of an illustrative embodiment of the present invention.

Figure 1:
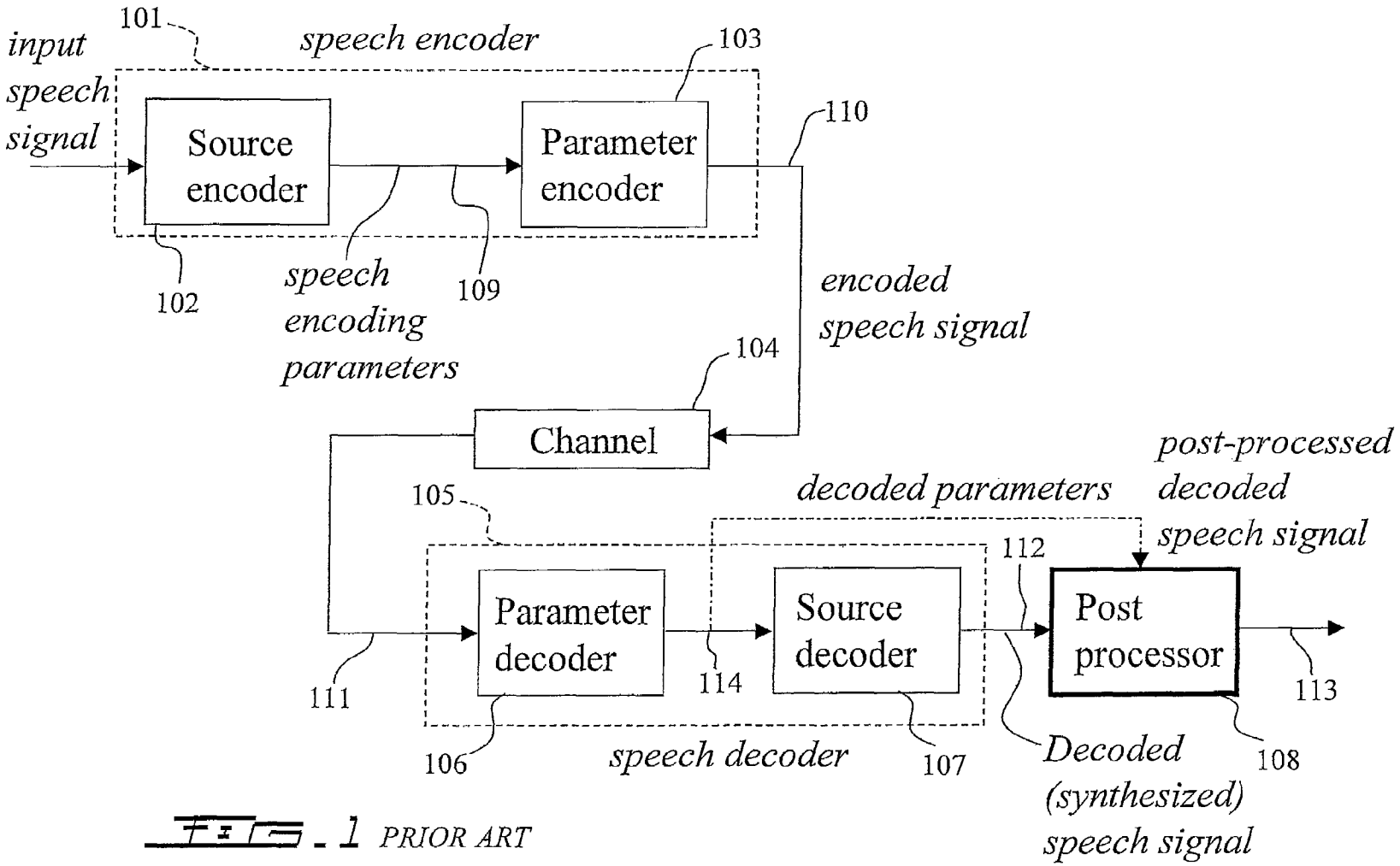
FIG. 1 PRIOR ART
FIG. 1 is a schematic block diagram of the high-level structure of an example of speech encoder/decoder system using post-processing at the decoder.

In FIG. 1, the input signal (signal on which post-processing is applied) is the decoded (synthesized) speech signal 112 produced by the speech decoder 105 (FIG. 1) at the receiver of a communications system (output of the source decoder 107 of FIG. 1). The aim is to produce a post-processed decoded speech signal at the output 113 of the post-processor 108 of FIG. 1 (which is also the output of processor 203 of FIG. 2) with enhanced perceived quality. This is achieved by first applying at least one, and possibly more than one, adaptive filtering operation to the input signal. 112 (see adaptive filters 201*a*, 201*b*, . . . , 201N). These adaptive filters will be described in the following description. It should be pointed out here that some of the adaptive filters 201*a* to 201N can be trivial functions whenever required, for example with the output equal to the input. The output 204*a*, 204*b*, . . . , 204N of each adaptive filter 201 *a*, 201*b*, . . . , 201N is then band-pass filtered through a sub-band filter 202*a*, 202*b*, . . . , 202N, respectively, and the post-processed decoded speech signal 113 is obtained by adding through a processor 203 the respective resulting outputs 205*a*, 205*b*, . . . , 205N of sub-band filters 202*a*, 202*b*, . . . , 202N.

In one illustrative embodiment, a two-band decomposition is used and adaptive filtering is applied only to the lower band. This results in a total post-processing that is mostly targeted at frequencies near the first harmonics of the synthesized speech signal.

Figure 3:
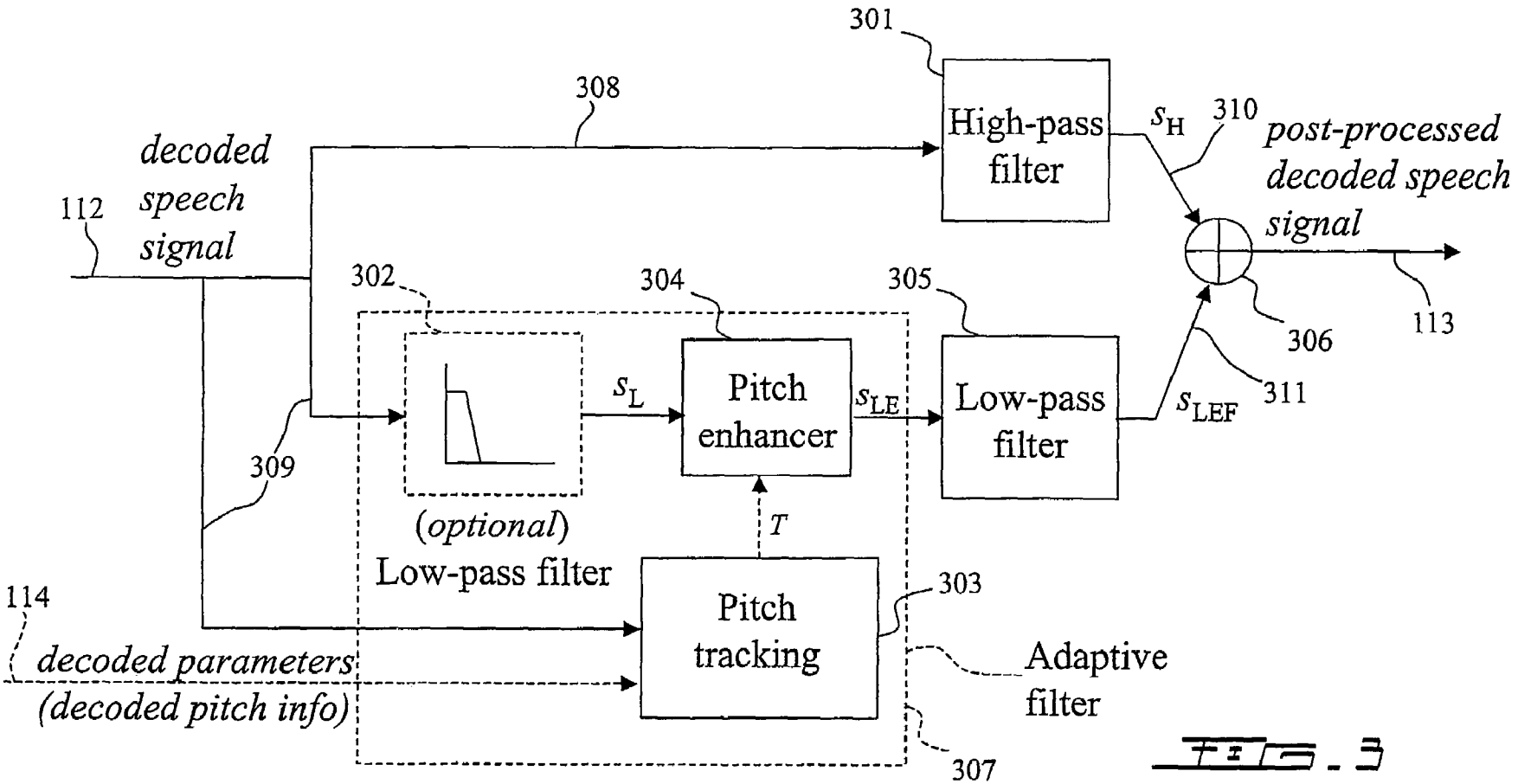
FIG. 3 is a schematic block diagram of a two-band pitch enhancer, which constitutes a special case of the illustrative embodiment of FIG. 2.

FIG. 3 is a schematic block diagram of a two-band pitch enhancer, which constitutes a special case of the illustrative embodiment of FIG. 2. More specifically, FIG. 3 shows the basic functions of a two-band post-processor (see post-processor 108 of FIG. 1). According to this illustrative embodiment, only pitch enhancement is considered as post-processing although other types of post-processing could be contemplated. In FIG. 3, the decoded speech signal (assumed to be the output 112 of the source decoder 107 of FIG. 1) is supplied through a pair of sub-branches 308 and 309.

In the higher branch 308, the decoded speech signal 112 is filtered by a high-pass filter 301 to produce the higher band signal 310 ($s_H$). In this specific example, no adaptive filter is used in the higher branch. In the lower branch 309, the decoded speech signal 112 is first processed through an adaptive filter 307 comprising an optional low-pass filter 302, a pitch tracking module 303, and a pitch enhancer 304, and then filtered through a low-pass filter 305 to obtain the lower band, post processed signal 311 ($s_{LEF}$). The post-processed decoded speech signal 113 is obtained by adding through an adder 306 the lower 311 and higher 312 band post-processed signals from the output of the low-pass filter 305 and high-pass filter 301, respectively. It should be pointed out that the low-pass 305 and high-pass 301 filters could be of many different types, for example Infinite Impulse Response (UR) or Finite Impulse Response (FIR). In this illustrative embodiment, linear phase FIR filters are used.

Therefore, the adaptive filter 307 of FIG. 3 is composed of two, and possibly three processors, the optional low-pass filter 302 similar to low-pass filter 305, the pitch tracking module 303 and the pitch enhancer 304.

Figure 8A:
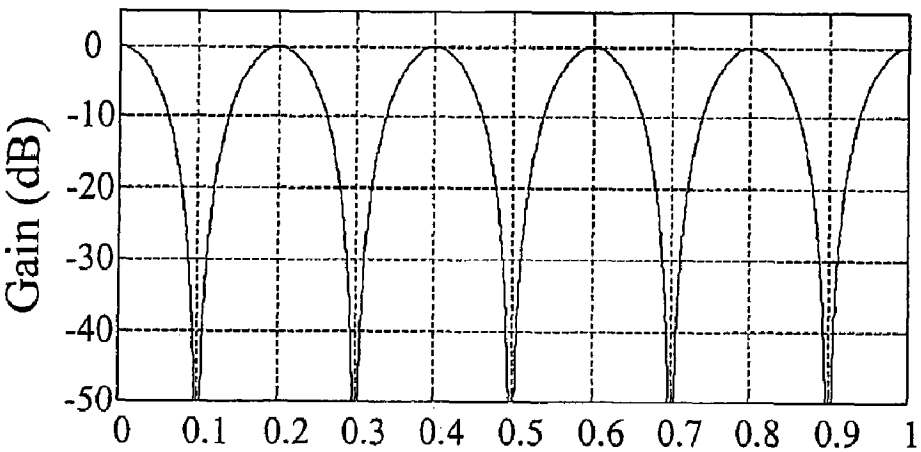
FIGS. 8*a* and 8*b* are graphs showing an example of the frequency response of a pitch enhancer filter as described by Equation (1), with the special case of a pitch period T=10 samples.
Figure 8B:
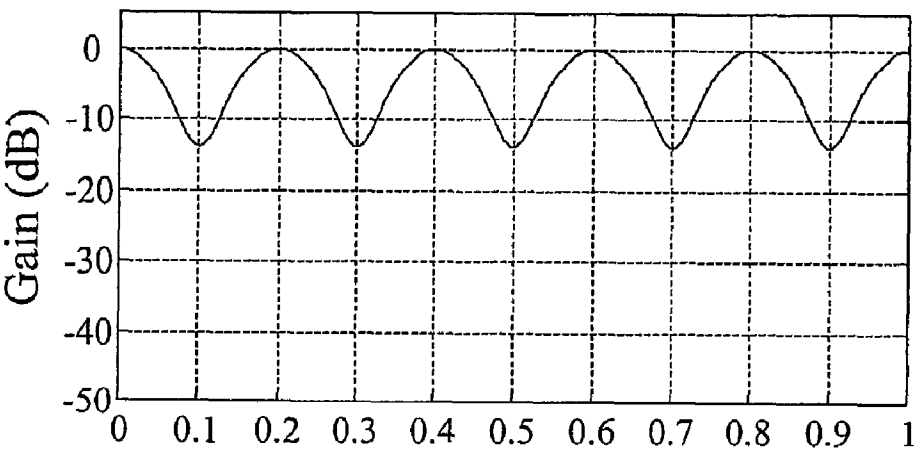

The low-pass filter 302 can be omitted, but it is included to allow viewing of the post-processing of FIG. 3 as a two-band decomposition followed by specific filtering in each sub-band. After optional low-pass filtering (filter 302) of the decoded speech signal 112 in the lower-band, the resulting signal $s_L$ is processed through the pitch enhancer 304. The object of the pitch enhancer 304 is to reduce the inter-harmonic noise in the decoded speech signal. In the present illustrative embodiment, the pitch enhancer 304 is achieved by a time-varying linear filter described by the following equation:

$$y(n) = \left(1 - \frac{\alpha}{2}\right)x[n] + \frac{\alpha}{4}\{x[n-T] + x[n+T]\} \tag{1}$$

where $\alpha$ is a coefficient that controls the inter-harmonic attenuation, T is the pitch period of the input signal x[n], and y[n] is the output signal of the pitch enhancer. A more general equation could also be used where the filter taps at n−T and n+T could be at different delays (for example n−T1 and n+T2). Parameters T and a vary with time and are given by the pitch tracking module 303. With a value of $\alpha=1$, the gain of the filter described by Equation (1) is exactly 0 at frequencies 1/(2T),3/(2T), 5/(2T), etc, i.e. at the mid-point between the harmonic frequencies 1/T, 3/T, 5/T, etc. When $\alpha$ approaches 0, the attenuation between the harmonics produced by the filter of Equation (1) reduces. With a value of $\alpha=0$, the filter output is equal to its input. FIG. 8 shows the frequency response (in dB) of the filter described by Equation (1) for the values $\alpha=0.8$ and 1, when the pitch delay is (arbitrarily) set at a value T=10 samples. The value of $\alpha$ can be computed using several approaches. For example, the normalized pitch correlation, which is well-known by those of ordinary skill in the art, can be used to control the coefficient $\alpha$: the higher the normalized pitch correlation (the closer to 1 it is), the higher the value of $\alpha$. A periodic signal x[n] with a period of T=10 samples would have harmonics at the maxima of the frequency responses of FIG. 8, i.e. at normalized frequencies 0.2, 0.4, etc. It is easy to understand from FIG. 8 that the pitch enhancer of Equation (1) would attenuate the signal energy only between its harmonics, and that the harmonic components would not be altered by the filter. FIG. 8 also shows that varying parameter $\alpha$ enables control of the amount of inter-harmonic attenuation provided by the filter of Equation (1). Note that the frequency response of the filter of Equation (1), shown in FIG. 8, extends to all frequencies of the spectrum.

Since the pitch period of a speech signal varies in time, the pitch value T of the pitch enhancer 304 has to vary accordingly. The pitch tracking module 303 is responsible for providing the proper pitch value T to the pitch enhancer 304, for every frame of the decoded speech signal that has to be processed. For that purpose, the pitch tracking module 303 receives as input not only the decoded speech samples but also the decoded parameters 114 from the parameter decoder 106 of FIG. 1.

Since a typical speech encoder extracts, for every speech subframe, a pitch delay which we call $T_0$ and possibly a fractional value $T_{0_frac}$ used to interpolate the adaptive codebook contribution to fractional sample resolution, the pitch tracking module 303 can then use this decoded pitch delay to focus the pitch tracking at the decoder. One possibility is to use $T_0$ and $T_{0_frac}$ directly in the pitch enhancer 304, exploiting the fact that the encoder has already performed pitch tracking. Another possibility, used in this illustrative embodiment, is to recalculate the pitch tracking at the decoder focussing on values around, and multiples or submultiples of, the decoded pitch value $T_0$. The pitch tracking module 303 then provides a pitch delay T to the pitch enhancer 304, which uses this value of T in Equation (1) for the present frame of decoded speech signal. The output is signal $s_{LE}$.

Pitch enhanced signal $s_{LE}$ is then low-pass filtered through filter 305 to isolate the low frequencies of the pitch enhanced signal $s_{LE}$, and to remove the high-frequency components that arise when the pitch enhancer filter of Equation (1) is varied in time, according to the pitch delay T, at the decoded speech frame boundaries. This produces the lower band post-processed signal $s_{LEF}$, which can now be added to the higher band signal $s_H$ in the adder 306. The result is the post-processed decoded speech signal 113, with reduced inter-harmonic noise in the lower band. The frequency band where pitch enhancement will be applied depends on the cut-off frequency of the low-pass filter 305 (and optionally in low-pass filter 302).

Figure 6A:
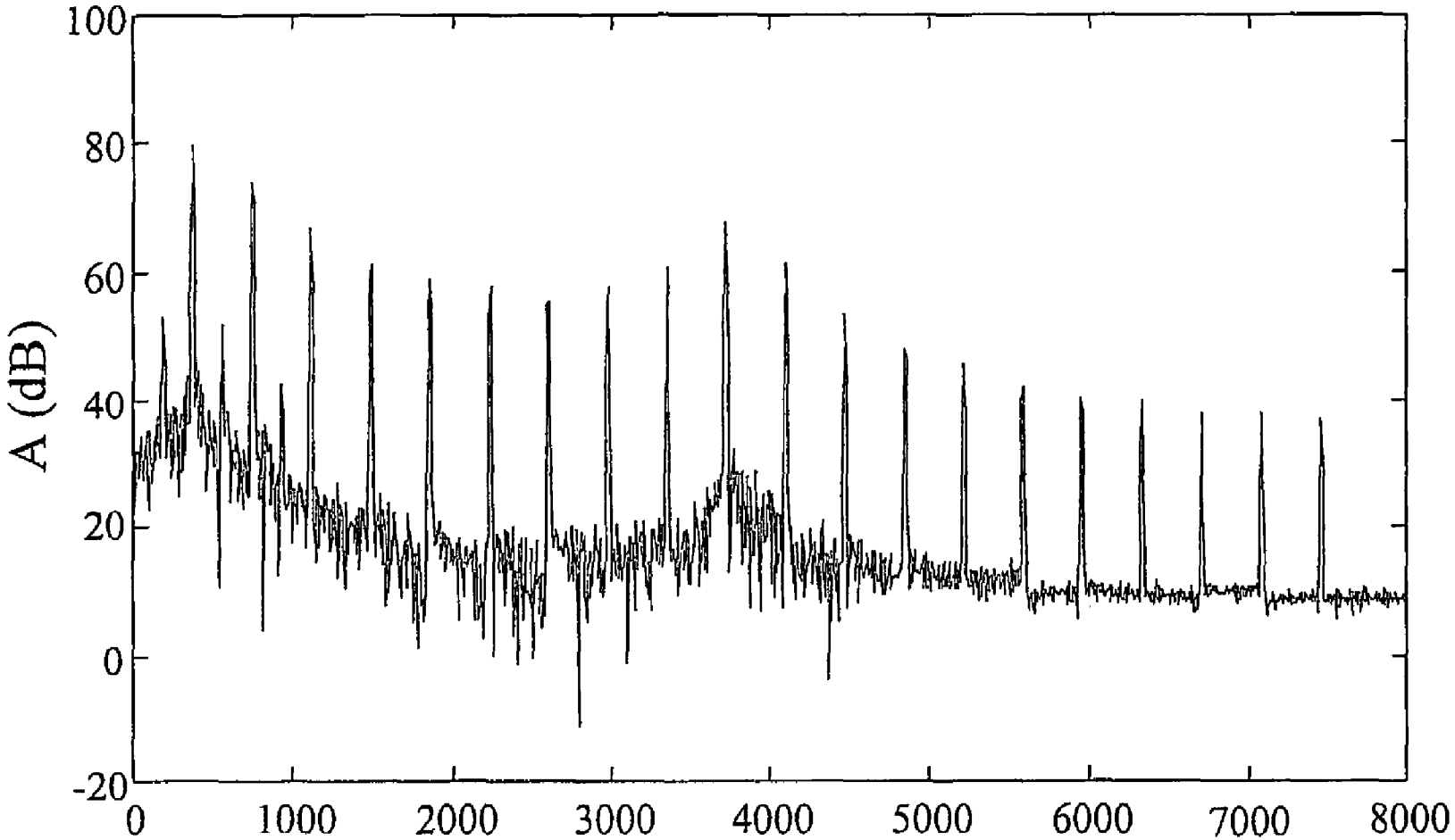
FIG. 6*a* is a graph illustrating an example of spectrum of a pre-processed signal.
Figure 6B:
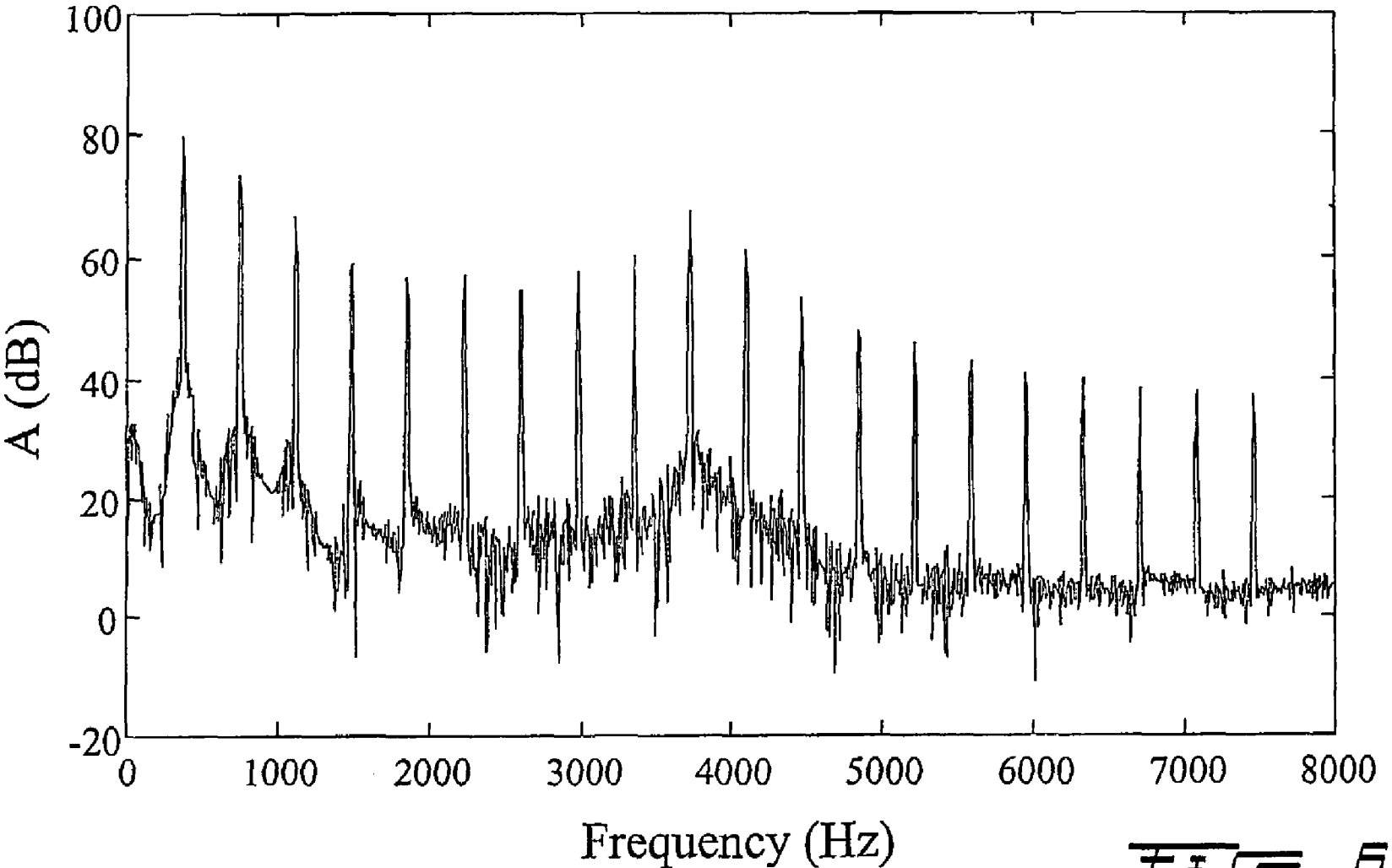
FIG. 6*b* is a graph illustrating an example of spectrum of the post-processed signal obtained when using the method described in FIG. 3.

FIGS. 6*a* and 6*b* show an example signal spectrum illustrating the effect of the post-processing described in FIG. 3. FIG. 6*a* is the spectrum of the input signal 112 of the post-processor 108 of FIG. 1 (decoded speech signal 112 in FIG. 3). In this illustrative example, the input signal is composed of 20 harmonics, with fundamental frequency $f_0$=373 Hz chosen arbitrarily, with <<noisy>> components added at frequencies $f_0/2$, $3f_0/2$ and $5f_0/2$. These three noisy components can be seen between the low-frequency harmonics in FIG. 6*a*. The sampling frequency is assumed to be 16 kHz in this example. The two-band pitch enhancer shown in FIG. 3 and described above is then applied to the signal of FIG. 6*a*. With a sampling frequency of 16 kHz and a periodic signal of fundamental frequency equal to 373 Hz as in FIG. 6*a*, the pitch tracking module 303 should find a period of T=16000/373 ≈43 samples. This is the value that was used for the pitch enhancer filter of Equation (1), applied to the pitch enhancer 304 of FIG. 3. A value of $\alpha=0.5$ was also used. The low-pass 305 and high-pass 301 filters are symmetric, linear phase FIR filters with 31 taps. The cut-off frequency for this example is chosen as 2000 Hz. These specific values are given only as an illustrative example.

The post-processed decoded speech signal 113 at the output of the adder 306 has a spectrum shown in FIG. 6*b*. It can be seen that the three inter-harmonic sinusoids in FIG. 6*a* have been completely removed, while the harmonics of the signal have been practically unaltered. Also it is noted that the effect of the pitch enhancer diminishes as the frequency approaches the low-pass filter cut-off frequency (2000 Hz in this example). Hence, only the lower band is affected by the post-processing. This is a key feature of this illustrative embodiment of the present invention. By varying the cut-off frequencies of the optional low-pass filter 302, low-pass filter 305 and high-pass filter 301, it is possible to control up to which frequency pitch enhancement is applied.

Application to the AMR-WB Speech Decoder

Figure 7:
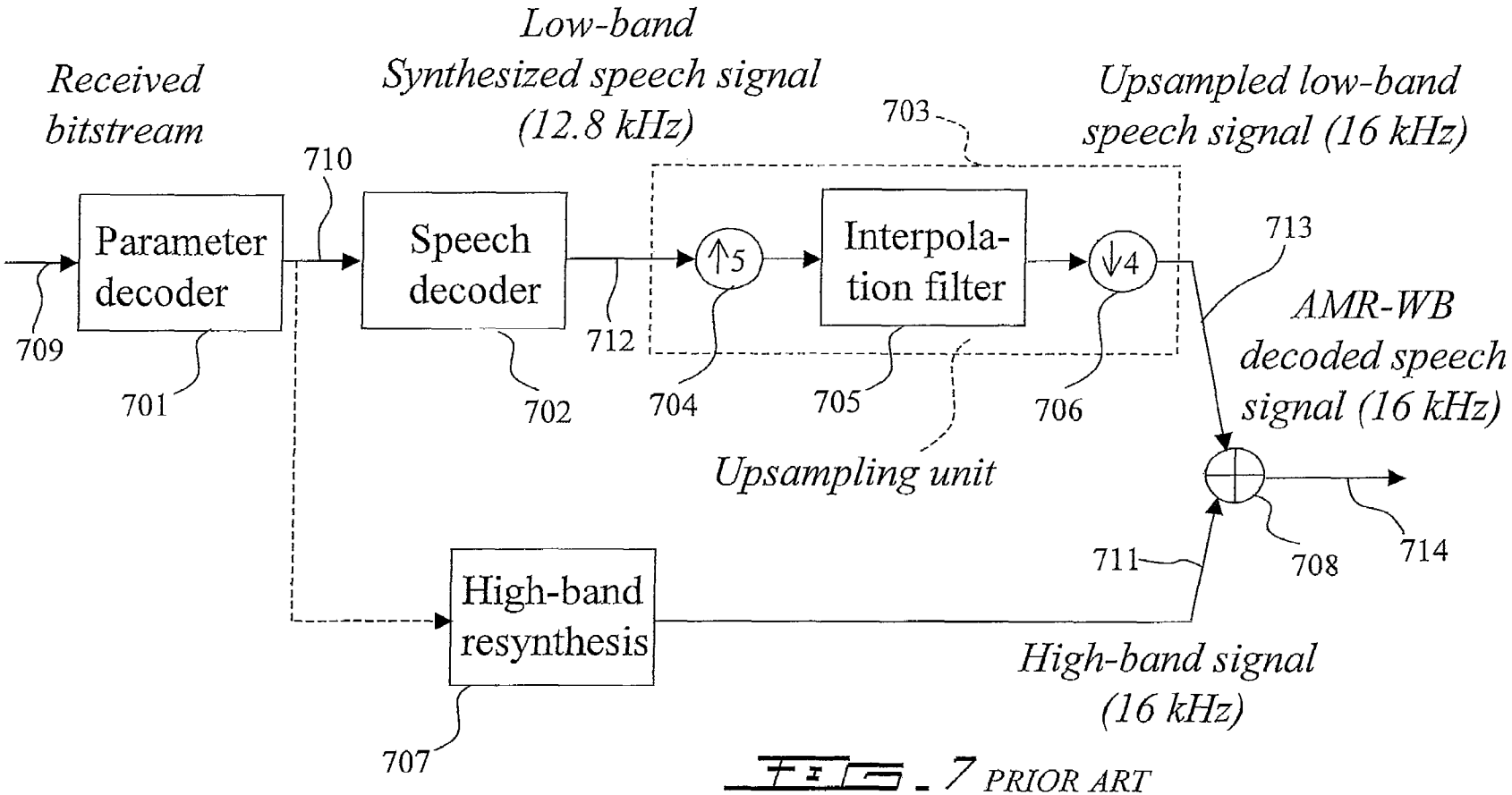
FIG. 7 PRIOR ART
FIG. 7 is a schematic block diagram showing the principle of operation of the 3GPP AMR-WB decoder.

The present invention can be applied to any speech signal synthesized by a speech decoder, or even to any speech signal corrupted by inter-harmonic noise that needs to be reduced. This section will show a specific, exemplary implementation of the present invention to an AMR-WB decoded speech signal. The post-processing is applied to the low-band synthesized speech signal 712 of FIG. 7, i.e. to the output of the speech decoder 702, which produces a synthesized speech at a sampling frequency of 12.8 kHz.

Figure 4:
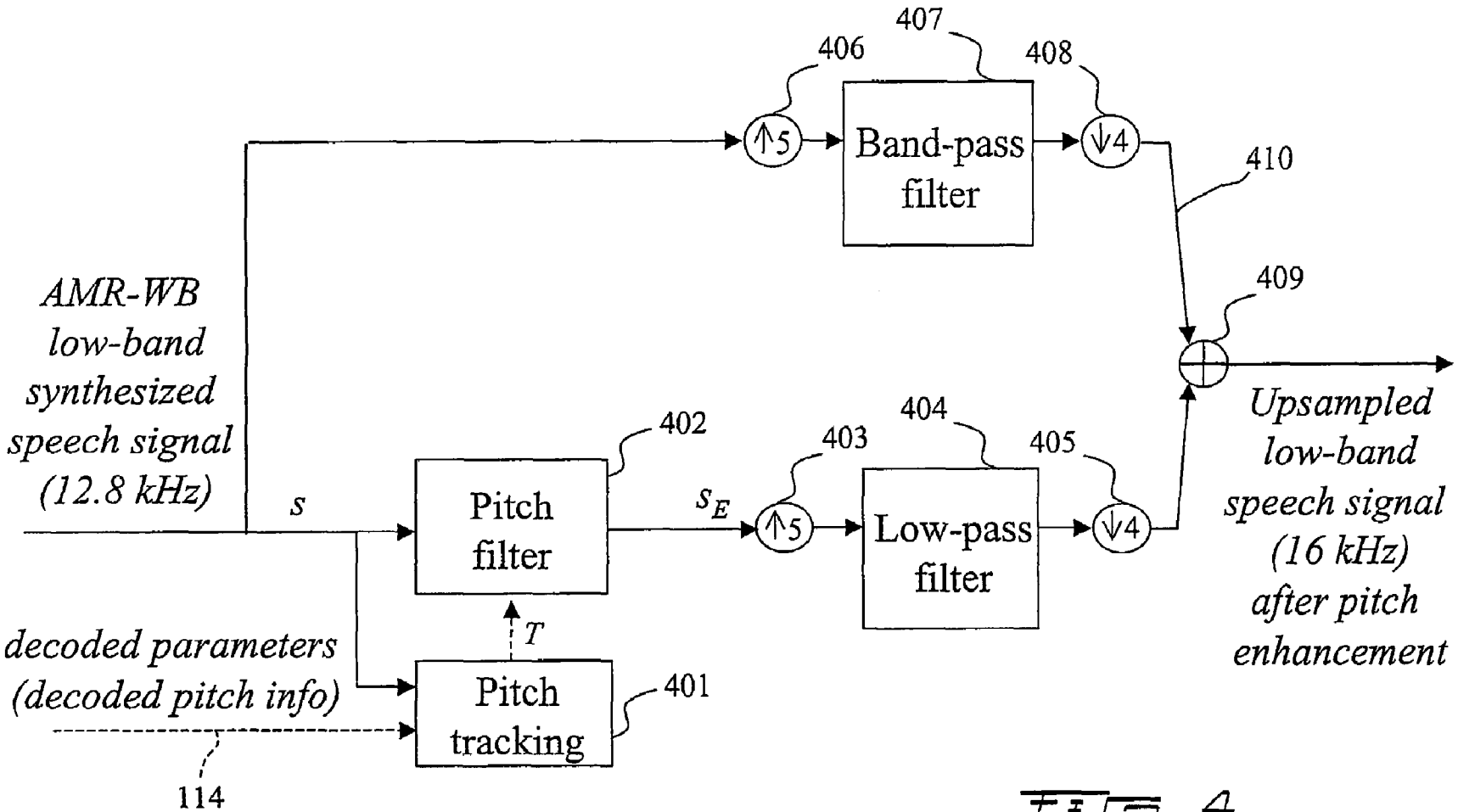
FIG. 4 is a schematic block diagram of an illustrative embodiment of the present invention, as applied to the special case of the AMR-WB wideband speech decoder.

FIG. 4 shows the block diagram of a pitch post-processor when the input signal is the AMR-WB low-band synthesized speech signal at the sampling frequency of 12.8 kHz. More precisely, the post-processor presented in FIG. 4 replaces the up-sampling unit 703, which comprises processors 704, 705 and 706. The pitch post-processor of FIG. 4 could also be applied to the 16 kHz up-sampled synthesized speech signal, but applying it prior to up-sampling reduces the number of filtering operations at the decoder, and thus reduces complexity.

The input signal (AMR-WB low-band synthesized speech (12.8 kHz)) of FIG. 4 is designated as signal s. In this specific example, signal s is the AMR-WB low-band synthesized speech signal at the sampling frequency of 12.8 kHz (output of processor 702). The pitch post-processor of FIG. 4 comprises a pitch tracking module 401 to determine, for every 5 millisecond subframe, the pitch delay T using the received, decoded parameters 114 (FIG. 1) and the synthesized speech signal s. The decoded parameters used by the pitch tracking module are $T_0$, the integer pitch value for the subframe, and $T_{0_frac}$, the fractional pitch value for subsample resolution. The pitch delay T calculated in the pitch tracking module 401 will be used in the next steps for pitch enhancement. It would be possible to use directly the received, decoded pitch parameters $T_0$ and $T_{0_frac}$ to form the delay T used by the pitch enhancer in the pitch filter 402. However, the pitch tracking module 401 is capable of correcting pitch multiples or sub-multiples, which could have a harmful effect on the pitch enhancement.

An illustrative embodiment of pitch tracking algorithm for the module 401 is the following (the specific thresholds and pitch tracked values are given only by way of example):

First, the decoded pitch information (pitch delay $T_0$) is compared to a stored value of the decoded pitch delay T_prev of the previous frame. T_prev may have been modified by some of the following steps according to the pitch tracking algorithm. For example, if $T_0$<1.16*T_prev then go to case 1 below, else if $T_0$>1.16*T_prev, then set T_temp=$T_0$ and go to case 2 below.

Case 1: First, calculate the cross-correlation C2 (cross-product) between the last synthesized subframe and the synthesis signal starting at $T_0/2$ samples before the beginning of the last subframe (look at correlation at half the decoded pitch value).

Then, calculate the cross-correlation C3 (cross-product) between the last synthesized subframe and the synthesis signal starting at $T_0/3$ samples before the beginning of the last subframe (look at correlation at one-third the decoded pitch value).

Then, select the maximum value between C2 and C3 and calculate the normalized correlation Cn (normalized version of C2 or C3) at the corresponding sub-multiple of $T_0$ (at $T_0/2$ if C2>C3 and at $T_0/3$ if C3>C2). Call T_new the pitch sub-multiple corresponding to the highest normalized correlation.

If Cn>0.95 (strong normalized correlation) the new pitch period is T_new (instead of $T_0$). Output the value T =T_new from the pitch tracking module 401. Save T_prev=T for next subframe pitch tracking and exit the pitch tracking module 401.

If 0.7<Cn<0.95, then save T_temp=$T_0/2$ or $T_0/3$ (according to C2 or C3 above) for comparisons in case 2 below. Otherwise, if Cn<0.7 save T_temp=$T_0$.

Case 2: Calculate all possible values of the ratio Tn=[T_temp/n]where [x] means the integer part of x and n=1,2,3, etc. is an integer.

Calculate all cross correlations Cn at the pitch delay submultiples Tn. Retain Cn_max as the maximum cross correlation among all Cn. If n>1 and Cn>0.8, output Tn as the pitch period output T of the pitch tracking unit 401. Otherwise, output T1=T temp. Here, the value of T_temp will depend on the calculations in Case 1 above.

It should be noted that the above example of pitch tracking module 401 is given for the purpose of illustration only. Any other pitch tracking method or device could be implemented in module 401 (or 303 and 502) to ensure a better pitch tracking at the decoder.

Therefore, the output of the pitch tracking module is the period T to be used in the pitch filter 402 which, in this preferred embodiment, is described by the filter of Equation (1). Again, a value of $\alpha=0$ implies no filtering (output of the pitch filter 402 is equal to its input), and a value of $\alpha=1$ corresponds to the highest amount of pitch enhancement.

Figure 9A:
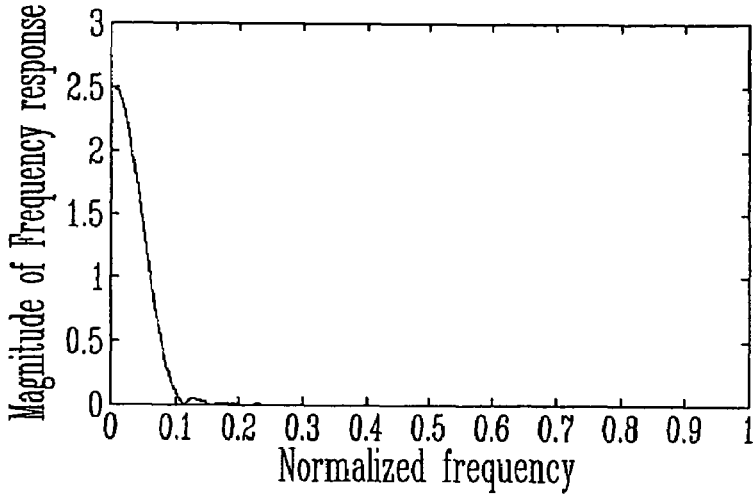
FIG. 9*a* is a graph showing an example of frequency response for the low-pass filter 404 of FIG. 4.
Figure 9B:
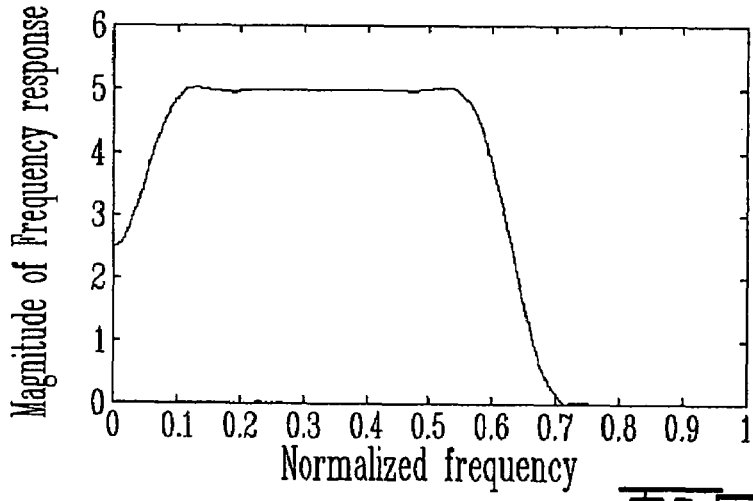
FIG. 9*b* is a graph showing an example of frequency response for the band-pass filter 407 of FIG. 4.
Figure 9C:
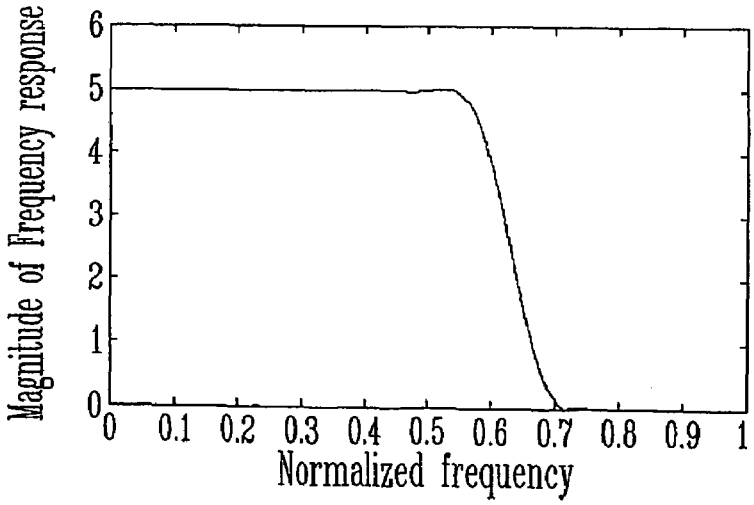
FIG. 9*c* is a graph showing an example of combined frequency response for the low-pass filter 404 and band-pass filters 407 of FIG. 4.

Once the enhanced signal $S_E$ (FIG. 4) is determined, it is combined with the input signal s such that, as in FIG. 3, only the lower band is subjected to pitch enhancement. In FIG. 4, a modified approach is used compared to FIG. 3. Since the pitch post-processor of FIG. 4 replaces the up-sampling unit 703 in FIG. 7, the sub-band filters 301 and 305 of FIG. 3 are combined with the interpolation filter 705 of FIG. 7 to minimize the number of filtering operations, and the filtering delay. More specifically, filters 404 and 407 of FIG. 4 act both as band-pass filters (to separate the frequency bands) and as interpolation filters (for up-sampling from 12.8 to 16 kHz). These filters 404 and 407 could be further designed such that the band-pass filter 407 has relaxed constraints in its low-frequency stop band (i.e. it does not have to completely attenuate the signal at low frequencies). This could be achieved by using design constraints similar to those shown in FIG. 9. FIG. 9*a* is an example of frequency response for the low-pass filter 404. It should be noted that the DC (Direct Current) gain of this filter is 5 (instead of 1) since this filter also acts as interpolation filter, with a 5/4 interpolation ratio which implies that the filter gain must be 5 at 0 Hz. Then, FIG. 9*b* shows the frequency response of the band-pass filter 407 making this filter 407 complementary, in the low band, to the low-pass filter 404. In this example, the filter 407 is a band-pass filter, not a high-pass filter such as filter 301, since it must act both as high-pass filter (such as filter 301) and low-pass filter (such as interpolation filter 705). Referring again to FIG. 9, we see that the low-pass and band-pass filters 404 and 407 are complementary when considered in parallel, as in FIG. 4. Their combined frequency response (when used in parallel) is shown in FIG. 9*c*.

For completeness, the tables of filter coefficients used in this illustrative embodiment of the filters 404 and 407 are given below. Of course, these tables of filter coefficients are given by way of example only. It should be understood that these filters can be replaced without modifying the scope, spirit and nature of the present invention.

TABLE 1

| Low-pass coefficients of filter 404 | |
|---|---|
| hlp[0] | 0.04375000000000 |
| hlp[1] | 0.04371500000000 |
| hlp[2] | 0.04361200000000 |
| hlp[3] | 0.04344000000000 |
| hlp[4] | 0.04320000000000 |
| hlp[5] | 0.04289300000000 |
| hlp[6] | 0.04252100000000 |
| hlp[7] | 0.04208300000000 |
| hlp[8] | 0.04158200000000 |
| hlp[9] | 0.04102000000000 |
| hlp[10] | 0.04039900000000 |
| hlp[11] | 0.03972100000000 |
| hlp[12] | 0.03898800000000 |
| hlp[13] | 0.03820200000000 |
| hlp[14] | 0.03736700000000 |
| hlp[15] | 0.03648600000000 |
| hlp[16] | 0.03556100000000 |
| hlp[17] | 0.03459600000000 |
| hlp[18] | 0.03359400000000 |
| hlp[19] | 0.03255800000000 |
| hlp[20] | 0.03149200000000 |
| hlp[21] | 0.03039900000000 |
| hlp[22] | 0.02928400000000 |
| hlp[23] | 0.02814900000000 |
| hlp[24] | 0.02699900000000 |
| hlp[25] | 0.02583700000000 |
| hlp[26] | 0.02466700000000 |
| hlp[27] | 0.02349300000000 |
| hlp[28] | 0.02231800000000 |
| hlp[29] | 0.02114600000000 |
| hlp[30] | 0.01998000000000 |
| hlp[31] | 0.01882400000000 |
| hlp[32] | 0.01768200000000 |
| hlp[33] | 0.01655700000000 |
| hlp[34] | 0.01545100000000 |
| hlp[35] | 0.01436900000000 |
| hlp[36] | 0.01331200000000 |
| hlp[37] | 0.01228400000000 |

TABLE 1-continued

| Low-pass coefficients of filter 404 | |
|---|---|
| hlp[38] | 0.01128600000000 |
| hlp[39] | 0.01032300000000 |
| hlp[40] | 0.00939500000000 |
| hlp[41] | 0.00850500000000 |
| hlp[42] | 0.00765500000000 |
| hlp[43] | 0.00684600000000 |
| hlp[44] | 0.00608100000000 |
| hlp[45] | 0.00535900000000 |
| hlp[46] | 0.00468200000000 |
| hlp[47] | 0.00405100000000 |
| hlp[48] | 0.00346700000000 |
| hlp[49] | 0.00292900000000 |
| hlp[50] | 0.00243900000000 |
| hlp[51] | 0.00199500000000 |
| hlp[52] | 0.00159900000000 |
| hlp[53] | 0.00124800000000 |
| hlp[54] | 0.00094400000000 |
| hlp[55] | 0.00068400000000 |
| hlp[56] | 0.00046800000000 |
| hlp[57] | 0.00029500000000 |
| hlp[58] | 0.00016300000000 |
| hlp[59] | 0.00007100000000 |
| hlp[60] | 0.00001800000000 |

TABLE 2

| Band-pass coefficients of filter 407 | |
|---|---|
| hbp[0] | 0.95625000000000 |
| hbp[1] | 0.89115400000000 |
| hbp[2] | 0.71120900000000 |
| hbp[3] | 0.45810600000000 |
| hbp[4] | 0.18819900000000 |
| hbp[5] | −0.04289300000000 |
| hbp[6] | −0.19474300000000 |
| hbp[7] | −0.25136900000000 |
| hbp[8] | −0.22287200000000 |
| hbp[9] | −0.13948000000000 |
| hbp[10] | −0.04039900000000 |
| hbp[11] | 0.03868100000000 |
| hbp[12] | 0.07548400000000 |
| hbp[13] | 0.06566500000000 |
| hbp[14] | 0.02113800000000 |
| hbp[15] | −0.03648600000000 |
| hbp[16] | −0.08465300000000 |
| hbp[17] | −0.10763400000000 |
| hbp[18] | −0.10087600000000 |
| hbp[19] | −0.07091900000000 |
| hbp[20] | −0.03149200000000 |
| hbp[21] | 0.00234200000000 |
| hbp[22] | 0.01970000000000 |
| hbp[23] | 0.01715300000000 |
| hbp[24] | −0.00110700000000 |
| hbp[25] | −0.02583700000000 |
| hbp[26] | −0.04678900000000 |
| hbp[27] | −0.05654900000000 |
| hbp[28] | −0.05281800000000 |
| hbp[29] | −0.03851900000000 |
| hbp[30] | −0.01998000000000 |
| hbp[31] | −0.00412400000000 |
| hbp[32] | 0.00414300000000 |
| hbp[33] | 0.00343300000000 |
| hbp[34] | −0.00416100000000 |
| hbp[35] | −0.01436900000000 |
| hbp[36] | −0.02267300000000 |
| hbp[37] | −0.02601800000000 |
| hbp[38] | −0.02370000000000 |
| hbp[39] | −0.01723200000000 |
| hbp[40] | −0.00939500000000 |
| hbp[41] | −0.00297000000000 |
| hbp[42] | 0.00030500000000 |
| hbp[43] | 0.00019000000000 |
| hbp[44] | −0.00226000000000 |
| hbp[45] | −0.00535900000000 |

TABLE 2-continued

| Band-pass coefficients of filter 407 | |
|---|---|
| hbp[46] | −0.00756800000000 |
| hbp[47] | −0.00805800000000 |
| hbp[48] | −0.00687000000000 |
| hbp[49] | −0.00469500000000 |
| hbp[50] | −0.00243900000000 |
| hbp[51] | −0.00080600000000 |
| hbp[52] | −0.00006300000000 |
| hbp[53] | −0.00005300000000 |
| hbp[54] | −0.00038700000000 |
| hbp[55] | −0.00068400000000 |
| hbp[56] | −0.00074400000000 |
| hbp[57] | −0.00057600000000 |
| hbp[58] | −0.00031900000000 |
| hbp[59] | −0.00011300000000 |
| hbp[60] | −0.00001800000000 |

The output of the pitch filter 402 of FIG. 4 is called $S_E$. To be recombined with the signal of the upper branch, it is first up-sampled by processor 403, low-pass filter 404 and processor 405, and added through an adder 409 to the up-sampled upper branch signal 410. The up-sampling operation in the upper branch is performed by processor 406, band-pass filter 407 and processor 408.

Alternate Implementation of the Proposed Pitch Enhancer

Figure 5:
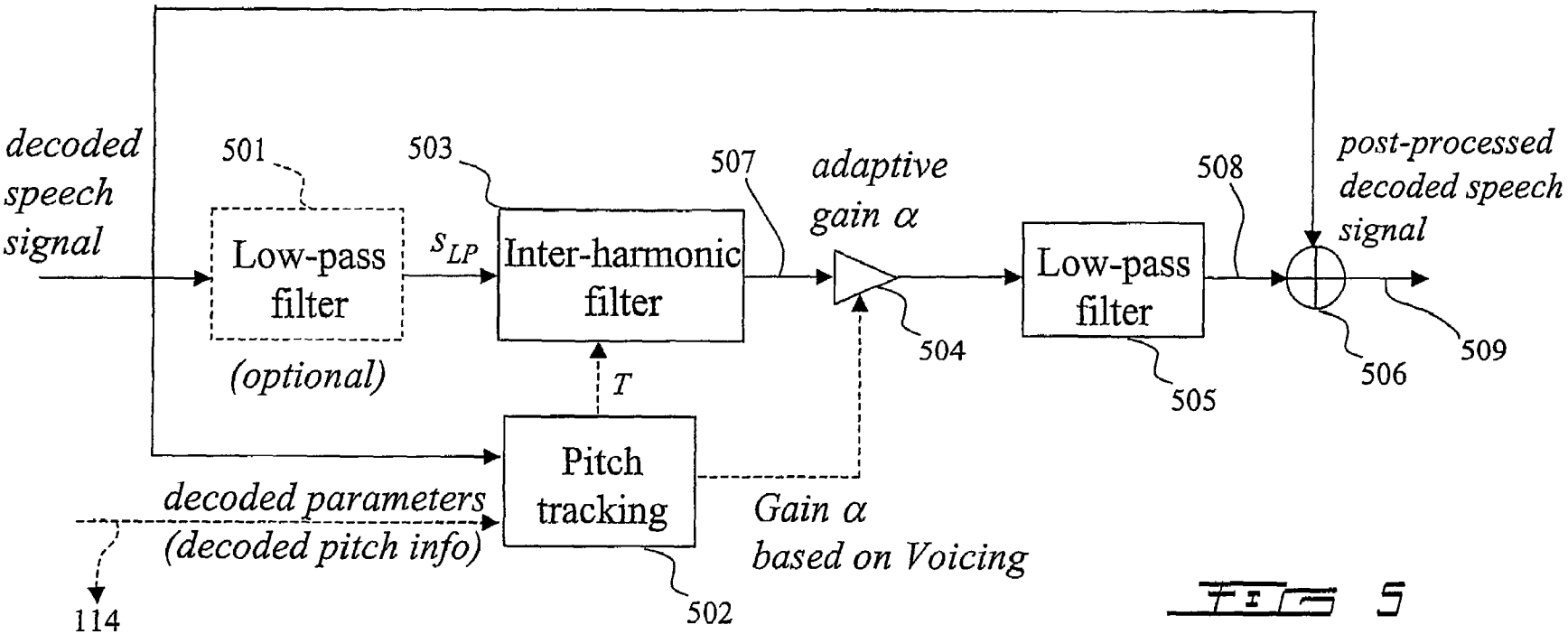
FIG. 5 is a schematic block diagram of an alternative implementation of the illustrative embodiment of FIG. 4.

FIG. 5 shows an alternative implementation of a two-band pitch enhancer according to an illustrative embodiment of the present invention. It should be noted that the upper branch of FIG. 5 does not process the input signal at all. This means that, in this particular case, the filters in the upper branch of FIG. 2 (adaptive filters 201*a* and 201*b*) have trivial input-output characteristics (output is equal to input). In the lower branch, the input signal (signal to be enhanced) is processed first through an optional low-pass filter 501, then through a linear filter called inter-harmonic filter 503, defined by the following equation:

$$y[n] = \frac{1}{2}x[n] - \frac{1}{4}\{x[n-T] + x[n+T]\} \tag{2}$$

Figure 10:
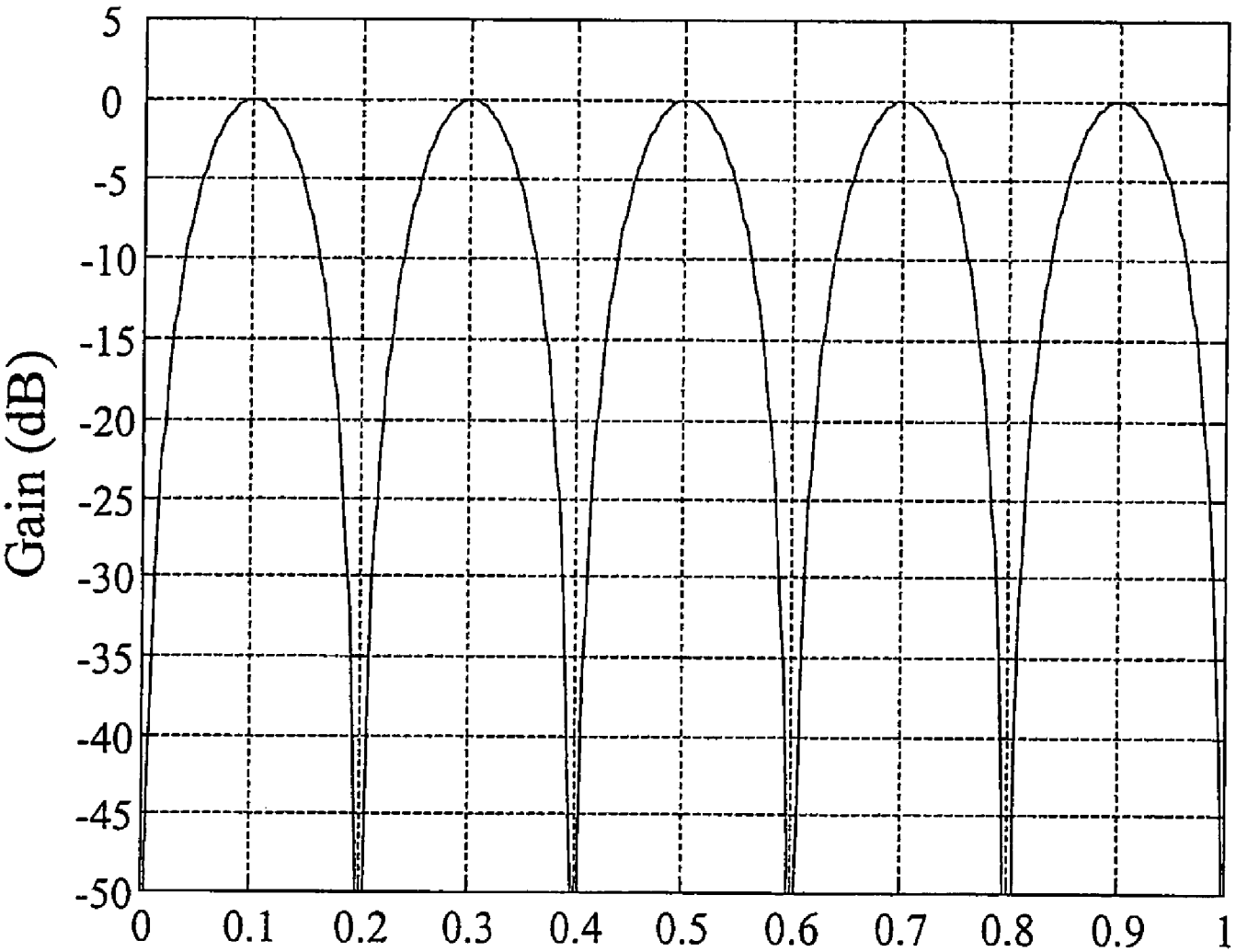
FIG. 10 is a graph showing an example of the frequency response of an inter-harmonic filter as described by Equation (2), and used in the inter-harmonic filter 503 of FIG. 5, for the specific case of T=10 samples.

It should be noted that the negative sign in front of the second term on the right hand side, compared to Equation (1). It should also be noted that the enhancement factor $\alpha$ is not included in Equation (2), but rather it is introduced by means of an adaptive gain by the processor 504 of FIG. 5. The inter-harmonic filter 503, described by Equation (2), has a frequency response such that it completely removes the harmonics of a periodic signal having a period of T samples, and such that a sinusoid at a frequency exactly between the harmonics passes through the filter unchanged in amplitude but with a phase reversal of exactly 180 degrees (same as sign inversion). For example, FIG. 10 shows the frequency response of the filter described by Equation (2) when the period is (arbitrarily) chosen at T=10 samples. A periodic signal with period T=10 samples would present harmonics at normalized frequencies 0.2, 0.4, 0.6, etc., and FIG. 10 shows that the filter of Equation (2), with T=10 samples, would completely remove these harmonics. On the other hand, the frequencies at the exact mid-point between the harmonics would appear at the output of the filter with the same amplitude but with a 180° phase shift. This is the reason why the filter described by Equation (2) and used as filter 503 is called inter-harmonic filter.

The pitch value T for use in the inter-harmonic filter 503 is obtained adaptively by the pitch tracking module 502. Pitch tracking module 502 operates on the decoded speech signal and the decoded parameters, similarly to the previously disclosed methods as shown in FIGS. 3 and 4.

Then, the output 507 of the inter-harmonic filter 503 is a signal formed essentially of the inter-harmonic portion of the input decoded signal 112, with 180° phase shift at mid-point between the signal harmonics. Then, the output 507 of the inter-harmonic filter 503 is multiplied by a gain $\alpha$ (processor 504) and subsequently low-pass filtered (filter 505) to obtain the low frequency band modification that is applied to the input decoded speech signal 112 of FIG. 5, to obtain the post-processed decoded signal (enhanced signal) 509. The coefficient $\alpha$ in processor 504 controls the amount of pitch or inter-harmonic enhancement. The closer to 1 is $\alpha$, the higher the enhancement is. When $\alpha$ is equal to 0, no enhancement is obtained, i.e. the output of adder 506 is exactly equal to the input signal (decoded speech in FIG. 5). The value of $\alpha$ can be computed using several approaches. For example, the normalized pitch correlation, which is well known to those of ordinary skill in the art, can be used to control coefficient $\alpha$: the higher the normalized pitch correlation (the closer to 1 it is), the higher the value of $\alpha$.

The final post-processed decoded speech signal 509 is obtained by adding through an adder 506 the output of low-pass filter 505 to the input signal (decoded speech signal 112 of FIG. 5). Depending on the cut-off frequency of the low-pass filter 505, the impact of this post-processing will be limited to the low frequencies of the input signal 112, up to a given frequency. The higher frequencies will be effectively unaffected by the post-processing.

One-Band Alternative Using an Adaptive High-Pass Filter

One last alternative for implementing sub-band post-processing for enhancing the synthesis signal at low frequencies is to use an adaptive high-pass filter, whose cut-off frequency is varied according to the input signal pitch value. Specifically, and without referring to any drawing, the low frequency enhancement using this illustrative embodiment would be performed, at each input signal frame, according to the following steps:

1. Determine the input signal pitch value (signal period) using the input signal and possibly the decoded parameters (output of speech decoder 105) if post-processing a decoded speech signal; this is a similar operation as the pitch tracking operation of modules 303, 401 and 502.
2. Calculate the coefficients of a high-pass filter such that the cut-off frequency is below, but close to, the fundamental frequency of the input signal; alternatively, interpolate between pre-calculated, stored high-pass filters of known cut-off frequencies (the interpolation can be done in the filtertaps domain, or in the pole-zero domain, or in some other transformed domain such as the LSF (Line Spectral Frequencies) of ISF (Immitance Spectral Frequencies) domain).
3. Filter the input signal frame with the calculated high-pass filter, to obtain the post-processed signal for that frame.

It should be pointed out that the present illustrative embodiment of the present invention is equivalent to using only one processing branch in FIG. 2, and to define the adaptive filter of that branch as a pitch-controlled high-pass filter. The post-processing achieved with this approach will only affect the frequency range below the first harmonic and not the inter-harmonic energy above the first harmonic.

Although the present invention has been described in the foregoing description with reference to illustrative embodiments thereof, these embodiments can be modified at will, within the scope of the appended claims without departing from the spirit and nature of the present invention. For example, although the illustrative embodiments have been described in relation to a decoded speech signal, those of ordinary skill in the art will appreciate that the concepts of the present invention can be applied to other types of decoded signals, in particular but not exclusively to other types of decoded sound signals.

What is claimed is:

1. A method for post-processing a decoded sound signal in view of enhancing a perceived quality of said decoded sound signal, comprising:

dividing the decoded sound signal into a plurality of frequency sub-band signals; and applying post-processing to only a part of the frequency sub-band signals;

wherein applying post-processing to only a part of the frequency sub-band signals comprises pitch enhancing the frequency sub-band signals only in a lower frequency band of the decoded sound signal.

2. A post-processing method as defined in claim 1, further comprising summing the frequency sub-band signals, after post-processing of said part of the frequency sub-band signals, to produce an output post-processed decoded sound signal.

3. A post-processing method as defined in claim 1, wherein pitch enhancing comprises adaptively filtering said part of the frequency sub-band signals.

4. A post-processing method as defined in claim 1, wherein dividing the decoded sound signal into a plurality of frequency sub-band signals comprises sub-band filtering the decoded sound signal to produce the plurality of frequency sub-band signals.

5. A post-processing method as defined in claim 1, wherein, for said part of the frequency sub-band signals:

pitch enhancing comprises adaptively filtering the decoded sound signal; and dividing the decoded sound signal comprises sub-band filtering the adaptively filtered decoded sound signal.

6. A post-processing method as defined in claim 1, wherein:

dividing the decoded sound signal into a plurality of frequency sub-band signals comprises:

a high-pass filtering of the decoded sound signal to produce a frequency high-band signal; and a first low-pass filtering of the decoded sound signal to produce a frequency low-band signal; and pitch enhancing comprises:

pitch enhancing the decoded sound signal prior to the first low-pass filtering of the decoded sound signal to produce the frequency low-band signal.

7. A post-processing method as defined in claim 6, further comprising a second low-pass filtering of the decoded sound signal prior to pitch enhancing said decoded sound signal.

8. A post-processing method as defined in claim 6, further comprising summing the frequency high-band and low-band signals to produce an output post-processed decoded sound signal.

9. A post-processing method as defined in claim 1, wherein:

dividing the decoded sound signal into a plurality of frequency sub-band signals comprises:

band-pass filtering the decoded sound signal to produce a frequency upper-band signal; and low-pass filtering the decoded sound signal to produce a frequency lower-band signal; and pitch enhancing comprises:

pitch enhancing the decoded sound signal prior to low-pass filtering the decoded sound signal to produce a frequency lower-band signal.

10. A post-processing method as defined in claim 9, further comprising summing the frequency upper-band and lower-band signals to produce an output post-processed decoded sound signal.

11. A post-processing method as defined in claim 1, wherein:

dividing the decoded sound signal into a plurality of frequency sub-band signals comprises:

low-pass filtering the decoded sound signal to produce a frequency low-band signal; and pitch enhancing comprises:

pitch enhancing the frequency low-band signal.

12. A post-processing method as defined in claim 11, wherein pitch enhancing comprises processing the decoded sound signal through an inter-harmonic filter for inter-harmonic attenuation of the decoded sound signal.

13. A post-processing method as defined in claim 12, wherein pitch enhancing comprises multiplying the inter-harmonic filtered decoded sound signal by an adaptive pitch enhancement gain.

14. A post-processing method as defined in claim 12, further comprising low-pass filtering the decoded sound signal prior to processing the decoded sound signal through the inter-harmonic filter.

15. A post-processing method as defined in claim 11, further comprising summing the decoded sound signal and the frequency low-band signal to produce an output post-processed decoded sound signal.

16. A post-processing method as defined in claim 11, wherein pitch enhancing comprises processing the decoded sound signal through an inter-harmonic filter having the following transfer function:

$$y[n] = \frac{1}{2}x[n] - \frac{1}{4}\{x[n-T] + x[n+T]\}$$

for inter-harmonic attenuation of the decoded sound signal, where x[n] is the decoded sound signal, y[n] is the inter-harmonic filtered decoded sound signal in a given sub-band, and T is a pitch delay of the decoded sound signal.

17. A post-processing method as defined in claim 16, further comprising summing the unprocessed decoded sound signal and the inter-harmonic filtered frequency low-band signal to produce an output post-processed decoded sound signal.

18. A post-processing method as defined in claim 1, wherein pitch enhancing comprises pitch enhancing the decoded sound signal using the following equation:

$$y[n] = \left(1 - \frac{\alpha}{2}\right)x[n] + \frac{\alpha}{4}\{x[n-T] + x[n+T]\}$$

where x[n] is the decoded sound signal, y[n] is the pitch enhanced decoded sound signal in a given sub-band, T is a pitch delay of the decoded sound signal, and $\alpha$ is a coefficient varying between 0 and 1 to control an amount of inter-harmonic attenuation of the decoded sound signal.

19. A post-processing method as defined in claim 18, comprising receiving the pitch delay T through a bitstream.

20. A post-processing method as defined in claim 18, comprising decoding the pitch delay T from a received, encoded bitstream.

21. A post-processing method as defined in claim 18, comprising calculating the pitch delay T in response to the decoded sound signal for an improved pitch tracking.

22. A post-processing method as defined in claim 1, wherein, during encoding, the sound signal is down-sampled from a higher sampling frequency to a lower sampling frequency, and wherein dividing the decoded sound signal into a plurality of frequency sub-band signals comprises up-sampling the decoded sound signal from the lower sampling frequency to the higher sampling frequency.

23. A post-processing method as defined in claim 22, wherein dividing the decoded sound signal into a plurality of frequency sub-band signals comprises sub-band filtering the decoded sound signal, and wherein the up-sampling of the decoded sound signal from the lower sampling frequency to the higher sampling frequency is combined to the sub-band filtering.

24. A post-processing method as defined in claim 22, comprising:

band-pass filtering the decoded sound signal to produce a frequency upper-band signal, said band-pass filtering of the decoded sound signal being combined with up-sampling of the decoded sound signal from the lower sampling frequency to the higher sampling frequency; and pitch enhancing the decoded sound signal and low-pass filtering the pitch enhanced decoded sound signal to produce a frequency lower-band signal, said low-pass filtering of the pitch enhanced decoded sound signal being combined with up-sampling of the post-processed decoded sound signal from the lower sampling frequency to the higher sampling frequency.

25. post-processing method as defined in claim 24, further comprising adding the frequency upper-band signal with the frequency lower-band signal to form an output post-processed and up-sampled decoded sound signal.

26. A post-processing method as defined in claim 24, wherein pitch enhancing the decoded sound signal comprises processing the decoded sound signal by means of the following equation:

$$y[n] = \left(1 - \frac{\alpha}{2}\right)x[n] + \frac{\alpha}{4}\{x[n-T] + x[n+T]\}$$

where x[n] is the decoded sound signal, y[n] is the pitch enhanced decoded sound signal in a given sub-band, T is a pitch delay of the decoded sound signal, and $\alpha$ is a coefficient varying between 0 and 1 to control an amount of inter-harmonic attenuation of the decoded sound signal.

27. A post-processing method as defined in claim 1, wherein:

dividing the decoded sound signal into a plurality of frequency sub-band signals comprises dividing the decoded sound signal into a frequency upper-band signal and a frequency lower-band signal; and pitch enhancing comprises pitch enhancing the frequency lower-band signal.

28. A post-processing method as defined in claim 1, wherein pitch enhancing comprises:

determining a pitch value of the decoded sound signal;

calculating, in relation to the determined pitch value, a high-pass filter with a cut-off frequency below a fundamental frequency of the decoded sound signal; and processing the decoded sound signal through the calculated high-pass filter.

29. A device for post-processing a decoded sound signal in view of enhancing a perceived quality of said decoded sound signal, comprising:

a divider of the decoded sound signal into a plurality of frequency sub-band signals; and a post-processor of only a part of the frequency sub-band signals;

wherein the post-processor comprises a pitch enhancer of the frequency sub-band signals only in a lower frequency band of the decoded sound signal.

30. A post-processing device as defined in claim 29, further comprising an adder for summing the frequency sub-band signals, after post-processing of said part of the frequency sub-band signals, to produce an output post-processed decoded sound signal.

31. A post-processing device as defined in claim 29, wherein the post-processor comprises an adaptive filter supplied with the decoded sound signal.

32. A post-processing device as defined in claim 29, wherein the divider comprises a sub-band filter supplied with the decoded sound signal.

33. A post-processing device as defined in claim 29, wherein, for said part of the frequency sub-band signals:

the post-processor comprises an adaptive filter supplied with the decoded sound signal to produce an adaptively filtered decoded sound signal; and the dividing means comprises a sub-band filter supplied with the adaptively filtered decoded sound signal.

34. A post-processing device as defined in claim 29, wherein:

the dividing means comprises:

a high-pass filter supplied with the decoded sound signal to produce a frequency high-band signal; and a first low-pass filter supplied with the decoded sound signal to produce a frequency low-band signal; and the pitch enhancer enhances the decoded sound signal prior to low-pass filtering the decoded sound signal through the first low-pass filter.

35. A post-processing device as defined in claim 34, wherein the post-processor further comprises a second low-pass filter supplied with the decoded sound signal to produce a low-pass filtered decoded sound signal supplied to the pitch enhancer.

36. A post-processing device as defined in claim 34, further comprising an adder for summing the frequency high-band and low-band signals to produce an output post-processed decoded sound signal.

37. A post-processing device as defined in claim 29, wherein:

the divider comprises:

a band-pass filter supplied with the decoded sound signal to produce a frequency upper-band signal; and a low-pass filter supplied with the decoded sound signal to produce a frequency lower-band signal; and the pitch enhancer enhances the decoded sound signal prior to low-pass filtering the decoded sound signal through the low-pass filter to produce the frequency lower-band signal.

38. A post-processing device as defined in claim 37, wherein the pitch enhancer comprises a pitch filter supplied with the decoded sound signal to produce a pitch enhanced decoded sound signal supplied to the low-pass filter.

39. A post-processing device as defined in claim 37, further comprising an adder for summing the frequency upper-band and lower-band signals to produce an output post-processed decoded sound signal.

40. A post-processing device as defined in claim 29, wherein: the divider comprises:

a low-pass filter supplied with the decoded sound signal to produce a frequency low-band signal; and the pitch enhancer enhances the decoded sound signal to produce a post-processed pitch enhanced decoded sound signal supplied to the low-pass filter.

41. A post-processing device as defined in claim 40, wherein the pitch enhancer comprises an inter-harmonic filter supplied with the decoded sound signal to produce an inter-harmonic, attenuated decoded sound signal.

42. A post-processing device as defined in claim 41, wherein the pitch enhancer comprises a multiplier for multiplying the inter-harmonic, attenuated decoded sound signal by an adaptive pitch enhancement gain.

43. A post-processing device as defined in claim 41, further comprising a low-pass filter supplied with the decoded sound signal to produce a low-pass filtered decoded sound signal supplied to the inter-harmonic filter.

44. A post-processing device as defined in claim 40, further comprising an adder for summing the decoded sound signal and the frequency low-band signal to produce an output post-processed decoded sound signal.

45. A post-processing device as defined in claim 40, wherein the pitch enhancer comprises an inter-harmonic filter having the following transfer function:

$$y[n] = \frac{1}{2}x[n] - \frac{1}{4}\{x[n-T] + x[n+T]\}$$

for inter-harmonic attenuating the decoded sound signal, where x[n] is the decoded sound signal, y[n] is the inter-harmonic filtered decoded sound signal in a given sub-band, and T is a pitch delay of the decoded sound signal.

46. A post-processing device as defined in claim 45, further comprising an adder for summing the unprocessed decoded sound signal and the inter-harmonic filtered frequency low-band signal to produce an output post-processed decoded sound signal.

47. A post-processing device as defined in claim 29, wherein the pitch enhancer of the decoded sound signal uses the following equation:

$$y[n] = \left(1 - \frac{\alpha}{2}\right)x[n] + \frac{\alpha}{4}\{x[n-T] + x[n+T]\}$$

where x[n] is the decoded sound signal, y[n] is the pitch enhanced decoded sound signal in a given sub-band, T is a pitch delay of the decoded sound signal, and $\alpha$ is a coefficient varying between 0 and 1 to control an amount of inter-harmonic attenuation of the decoded sound signal.

48. A post-processing device as defined in claim 47, comprising a receiver of the pitch delay T through a bitstream.

49. A post-processing device as defined in claim 47, comprising a decoder of the pitch delay T from a received, encoded bitstream.

50. A post-processing device as defined in claim 47, comprising a calculator of the pitch delay T in response to the decoded sound signal for an improved pitch tracking.

51. A post-processing device as defined in claim 29, wherein, during encoding, the sound signal is down-sampled from a higher sampling frequency to a lower sampling frequency, and wherein the divider comprises an up-sampler of the decoded sound signal from the lower sampling frequency to the higher sampling frequency.

52. A post-processing device as defined in claim 51, wherein the divider comprises a sub-band filter supplied with the decoded sound signal, and wherein the up-sampler is combined with the sub-band filter.

53. A post-processing device as defined in claim 51, wherein:

the pitch enhancer enhances the decoded sound signal; and the divider comprises:

a band-pass filter supplied with the decoded sound signal to produce a frequency upper-band signal, said band-pass filter being combined with the up-sampler; and a low-pass filter supplied with the pitch enhanced decoded sound signal to produce a frequency lower-band signal, said low-pass filter being combined with the up-sampler.

54. A post-processing device as defined in claim 53, further comprising an adder for summing the frequency upper-band signal with the frequency lower-band signal to form an output pitch-enhanced and up-sampled decoded sound signal.

55. A post-processing device as defined in claim 53, wherein the pitch enhancer uses the following equation:

$$y[n] = \left(1 - \frac{\alpha}{2}\right)x[n] + \frac{\alpha}{4}\{x[n-T] + x[n+T]\}$$

where x[n] is the decoded sound signal, y[n] is the pitch enhanced decoded sound signal in a given sub-band, T is a pitch delay of the decoded sound signal, and $\alpha$ is a coefficient varying between 0 and 1 to control an amount of inter-harmonic attenuation of the decoded sound signal.

56. A post-processing device as defined in claim 29, wherein:

the divider divides the decoded sound signal into a frequency upper-band signal and a frequency lower-band signal; and the pitch enhancer enhances the frequency lower-band signal.

57. A post-processing device as defined in claim 29, wherein the pitch enhancer:

determines a pitch value of the decoded sound signal;

calculates, in relation to the determined pitch value, a high-pass filter with a cut-off frequency below a fundamental frequency of the decoded sound signal; and processes the decoded sound signal through the calculated high-pass filter.

58. A sound signal decoder comprising:

an input for receiving an encoded sound signal;

a parameter decoder supplied with the encoded sound signal for decoding sound signal encoding parameters;

a sound signal decoder supplied with the decoded sound signal encoding parameters for producing a decoded sound signal; and a post-processing device as recited in any of claims 29 to 57 for post-processing the decoded sound signal in view of enhancing a perceived quality of said decoded sound signal.

* * * * *